US008746157B2

(12) United States Patent
Wang et al.

(10) Patent No.: US 8,746,157 B2
(45) Date of Patent: Jun. 10, 2014

(54) BOTTOM ASH DISCHARGING DEVICE FOR COAL-FIRED BOILER

(75) Inventors: Yuwei Wang, Beijing (CN); Zhenqiang Liu, Beijing (CN); Jing Zhang, Beijing (CN); Qian Yu, Beijing (CN)

(73) Assignee: Beijing Guodian Futong Science and Technology Development Co., Ltd., Beijing (CN)

( * ) Notice: Subject to any disclaimer, the term of this patent is extended or adjusted under 35 U.S.C. 154(b) by 30 days.

(21) Appl. No.: 13/407,785

(22) Filed: Feb. 29, 2012

(65) Prior Publication Data

US 2012/0160141 A1 Jun. 28, 2012

Related U.S. Application Data

(63) Continuation of application No. PCT/CN2010/001004, filed on Jul. 5, 2010.

(30) Foreign Application Priority Data

Aug. 31, 2009 (CN) ..... 2009 1 0091640

(51) Int. Cl.
*F23J 1/00* (2006.01)
*F23J 1/02* (2006.01)
*C10J 3/34* (2006.01)

(52) U.S. Cl.
USPC ..... 110/165 R

(58) Field of Classification Search
USPC ..... 110/165 R, 166, 167, 168, 169, 170, 110/259, 266, 232, 222
See application file for complete search history.

(56) References Cited

U.S. PATENT DOCUMENTS 2,038,805 A * 4/1936 Rutledge ..... 110/328
5,628,259 A * 5/1997 Kuennen et al. ..... 110/170

FOREIGN PATENT DOCUMENTS

CN 2459550 Y 11/2001
CN 2460873 Y 11/2001
CN 201059566 Y 5/2008
CN 201059566 Y * 5/2008 ..... F23J 1/06
CN 201289092 Y 8/2009
WO WO 2007/104502 * 9/2007 ..... F23J 1/02

OTHER PUBLICATIONS

English Machine Translation of CN 201059566 Y.*
English Machine Translation of CN 201059566 Y: Accessed May 9, 2013.*

* cited by examiner

*Primary Examiner* — Kenneth Rinehart
*Assistant Examiner* — Tavia Sullens
(74) *Attorney, Agent, or Firm* — Oliff PLC

(57) ABSTRACT

A bottom ash discharging device for a coal-fired boiler including: a clinker case, installed between a bottom ash hopper outlet of the coal-fired boiler and a bottom ash conveyer, an impact bar including a plurality of heat-resistant metal rods supporting inside the clinker case, a clinker crusher, installed above the impact bar for crushing the clinker, and a guiding device, installed between the bottom ash hopper outlet and the clinker crusher for limiting the clinker to drop into the clinker crushing area of the clinker crusher. The bottom ash discharging device ensures that the clinkers drop from the bottom ash hopper outlet to the rear area of the clinker crusher, and that the impact bar can be replaced and repaired without stopping the coal-fired boiler.

16 Claims, 8 Drawing Sheets

BOTTOM ASH DISCHARGING DEVICE FOR COAL-FIRED BOILER

CROSS-REFERENCE TO RELATED APPLICATIONS

This application is a continuation of International Patent Application No. PCT/CN2010/001004 with an international filing date of Jul. 5, 2010, designating the United States, now pending, and further claims priority benefits to Chinese Patent Application No. 200910091640.7 filed Aug. 31, 2009. The contents of all of the aforementioned applications, including any intervening amendments thereto, are incorporated herein by reference.

BACKGROUND OF THE INVENTION

1. Field of the Invention

The invention relates to a device for discharging clinker, and more particularly to a device that discharges the bottom ash from the coal-fired boilers.

2. Description of the Related Art

Conventional coal-fired boilers of power plants mainly utilize a wet-type bottom ash handling system/device and a dry-type bottom ash handling system/device.

For the wet-type bottom ash handling system, most of the high temperature big lumps and large clinkers may drop into water and then become granulated into smaller ones for convenient delivery.

However, there are some disadvantages with the wet-type bottom ash handling system, provided as below:

(1) The fact that the clinker drops from the bottom of the boiler directly into the cooling water may cause a waste of the combustible material in the clinker and a loss of physical heat, in addition, the generated steam may corrode the components installed at the bottom of the boiler.

(2) Much water is consumed, and the environment is polluted by the discharged waste water, which may lead to high disposal cost.

(3) The system is complicated and may cause high maintenance and repair cost.

Therefore, dry-type bottom ash handling technology is the most widely used technology at present. However, the granulation by water is not involved in the dry-type bottom ash handling equipment and thus large clinkers are generated, which may destroy the steel belt of the crusher if the clinker directly falls onto the steel belt, and various-size bottom ash may enter the crusher, thereby increasing the workload of crusher and causing low efficiency and high malfunction rate.

In practice, the bottom ash handling system may stop running, because the crusher is sometimes jammed by clinkers or overloaded, or the clinkers are too hard to crush, or even its chain becomes broken.

To solve the above problems, a dry-type conveying device for high temperature bottom ash of coal-fired boilers is disclosed. The device includes a steel belt conveyer, a hydraulic clinker crusher and impact bars installed above the conveyer, and the impact bars are installed underneath the hydraulic clinker crusher. The hydraulic clinker crusher and the impact bars are supported by the clinker case, and the upper portion of clinker case is connected with the bottom ash hopper outlet installed at the bottom of the coal-fire boiler, and the lower portion of clinker case is connected with the top of the steel belt conveyer. The impact bars are composed of a plurality of heat-resistant metal rods, two ends of the heat-resistant metal rod supported by the clinker case are respectively connected with a cooling water pipe, the metal rods of the impact bars are used as the guide rail of the clinker crushing body of the hydraulic clinker crusher, the contact portion of the clinker crushing body and the impact bars is wave-shaped, and the clinker crushing body has a form of jaw that engages with each other. The disposal of the clinker crusher and the impact bars at the bottom of coal-fired boiler prevents the large clinker from directly dropping onto the conveying belt, thereby avoiding the damage of the conveying belt, reducing the crushing workload, and increasing the service life of the clinker crusher and even the whole device.

However, the above-motioned high temperature dry-type bottom ash conveying device still has some disadvantages:

(1) In the above-motioned high temperature dry-type bottom ash conveying device, a portion of bottom ash from the outlet of the bottom ash hopper will not drop into the area where the clinker crushing body of the hydraulic clinker crusher is working, however, it may affect the normal working of the clinker crushing body if too much bottom ash is accumulated in this area.

(2) As the impact bars are fixed on the clinker case, once the impact bars are damaged or destroyed, the device has to be stopped working for repair or replacement, which may have bad influence on the normal power generation of the power plant.

(3) The fact that the clinker crushing body is the form of jaw that engages with each other, i.e. the cross section of the body is n-shaped, and the vertical section thereof is rectangle (referring to FIG. 1), so that large clinkers can be easily pushed to the cover instead of being impaled or penetrated by the clinker crushing body when the clinker crusher body is driven by the hydraulic cylinder with relative movement. Therefore, there may be lots of big-sized slag that are not crushed immediately, which may affect the efficiency of crushing.

SUMMARY OF THE INVENTION

In view of the above-described problems, it is one objective of the invention to provide a device for discharging bottom ash from bottom of a coal-fired boiler that can avoid clinkers from dropping out of the crushing area and of which impact bars can be replaced and repaired without stopping the coal-fired boiler.

To achieve the above objective, in accordance with one embodiment of the invention, there provided is a bottom ash discharging device for a coal-fired boiler comprising a clinker case, an impact bar, a clinker crusher, and an ash guiding device, wherein the impact bar comprises a plurality of heat-resistant metal rods inside the clinker case; the clinker crusher is installed above the impact bar for crushing clinkers; the ash guiding device is installed between a bottom ash hopper outlet and the clinker crusher for limiting the clinkers to drop into a clinker crushing area; and an upper end of the ash guiding device is connected to the bottom ash hopper outlet.

In a class of this embodiment, the clinker case is installed between the bottom ash hopper outlet of the coal-fired boiler and a bottom ash conveyer.

In a class of this embodiment, the guiding device is a guiding plate installed around the bottom ash hopper outlet.

In a class of this embodiment, the clinker crusher comprises at least a pair of clinker crushing components with relative movement for crushing the bottom ash and a driving device for driving the clinker crushing components; an clinker crushing body is installed on the front end of each clinker crushing component; a baffle plate extending upwardly is installed on the rear end of each clinker crushing component; and the guiding plate is closer than the baffle plate to the clinker crushing body.

In a class of this embodiment, the bottom edge of the guiding plate is lower than the top edge of the baffle plate.

In a class of this embodiment, the impact bar is dismountable and fixed on the clinker case.

In a class of this embodiment, two ends of the heat-resistant metal rod are fixed on the clinker case through supporting beams; at least one end of the heat-resistant metal rod is dismountable and fixed on the clinker case through a stop means for restricting the axial movement of the heat-resistant metal rod.

In a class of this embodiment, the stop means comprises an opening installed on the side wall of the clinker case for benefiting for pulling out the heat-resistant metal rod and a cover installed outside of the clinker case for fixing the heat-resistant metal rod; there are holes on the cover for allowing the end of the heat-resistant metal rod to pass through the cover, and small holes vertical to the shaft of the heat-resistant metal rod are installed outside the clinker case; and dowels pass through the holes and cooperate with the cover for limiting the axis movement of heat-resistant metal rod.

In a class of this embodiment, the stop means comprises an opening installed on the side wall of the clinker case for benefiting for pulling out the heat-resistant metal rod and a cover installed outside of the clinker case for fixing the heat-resistant metal rod; there are holes on the cover for allowing the end of the heat-resistant metal rod to pass through the plate; and screw holes, formed on the end fixed on stop means of the heat-resistant metal rod, cooperate with dowels that passing through the cover holes for fixing the heat-resistant metal rod.

In a class of this embodiment, each of the clinker crushing components comprises a plurality of clinker crushing bodies, and a plurality of cone-shaped clinker crushing jaws are formed vertically on the extrusion end of the clinker crushing bodies.

In a class of this embodiment, the cone angle of the clinker crushing jaws is 60°-90°.

In a class of this embodiment, the shape of the clinker crushing jaws is in the form of rectangular pyramid.

In a class of this embodiment, the driving device is a hydraulic cylinder, and each clinker crushing body is driven by two hydraulic cylinders in parallel connection.

In a class of this embodiment, a pushing rod is installed between the clinker crusher component and the hydraulic cylinder for the transmission of driving force between the hydraulic cylinder and the clinker crusher component.

In a class of this embodiment, a protection plate is disposed above the clinker crusher component for protection of the clinker crushing body; a bottom ash discharging device is installed underneath the impact bar which is not covered by the protection plate.

In a class of this embodiment, the bottom ash discharging device is an ash discharging door installed on the clinker case.

In a class of this embodiment, the bottom ash discharging device is an ash silo with an ash discharging door, which is formed on the clinker case.

In a class of this embodiment, the clinker case further comprises: an observation window and/or a camera window for observing the state of the accumulation of large clinker dropped on the impact bar; and an observation hole for observing the state of ash storage in the ash storage device.

Advantages of the invention are summarized below:

(1) The guiding device for guiding the clinker to drop into the clinker-crushing area of the clinker crusher, disposed between the slag hopper outlet and the slag crusher, with the upper end connected to the slag hopper outlet, may prevent the slag from dropping into the area where the clinker crushing body cannot reach.

(2) Each heat-resistant metal rod is in dismountable fixed connection with the clinker case, and the axial movement is restricted by the stop means. Once one of heat-resistant metal rods is broken or in need of replacement, it only needs to pull such a rod out, and is unnecessary to change the whole impact bar, so that there is no need to stop the working of the coal-fire boiler, thereby increasing the efficiency and lowering the cost.

(3) The fact that the clinker crushing body is in the form of cone-shaped clinker crushing jaws, especially, a plurality of such jaws installed on the crushing working surface of the clinker crushing body in the erect direction can allow the clinker crushing body to provide larger pressure intensity on the clinker than conventional flat jaws, so as to engage the irregularly-shaped large clinker more firmly and be easily crushed. The cone angle of the jaws is 60°-90°, which can not only avoid the low intensity and snapping of the jaws in the case that the jaws are with too small cone angle, but also prevent smaller pressure intensity caused by bigger cone angle which is not conducive to impale the irregularly shaped large clinker.

Figure 1:
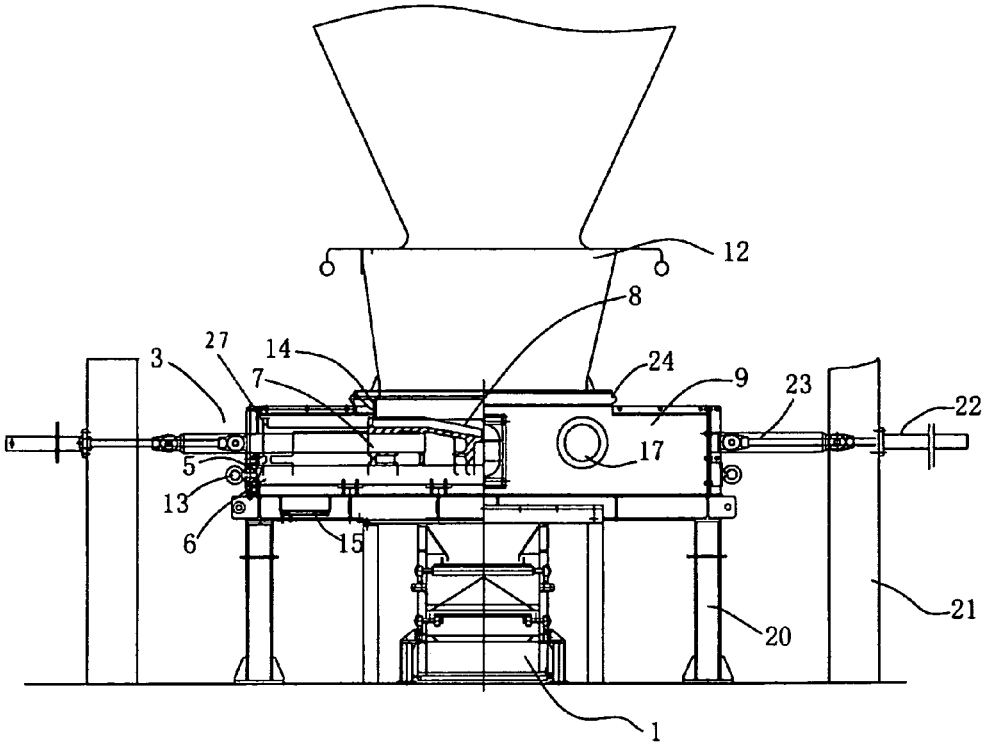
FIG. 1 is a front view of a bottom ash discharging device for a coal-fired boiler in accordance with one embodiment of the invention.

In the drawings, the following reference numbers are used: 1-bottom ash conveyer, 2-impact bar, 3-clinker crusher, 4-bottom ash hopper outlet, 5-supporting beam, 6-heat-resistant metal rod, 7-clinker crushing body, 8-clinker crushing jaw, 9-clinker case, 10-cover, 11-screw hole, 12-bottom ash hopper, 13-ringbolt, 14-guiding plate, 15-ash silo, 16-observation hole, 17-observation window, 18-camera window, 19-camera, 20-clinker case supporting structure, 21-bottom ash hopper supporting structure, 22-hydraulic cylinder, 23-pushing rod, 24-expansion joint, 25-clinker crushing component, 26-protection plate, 27-baffle plate, 28-chute.

DETAILED DESCRIPTION OF THE EMBODIMENTS

Figure 2:
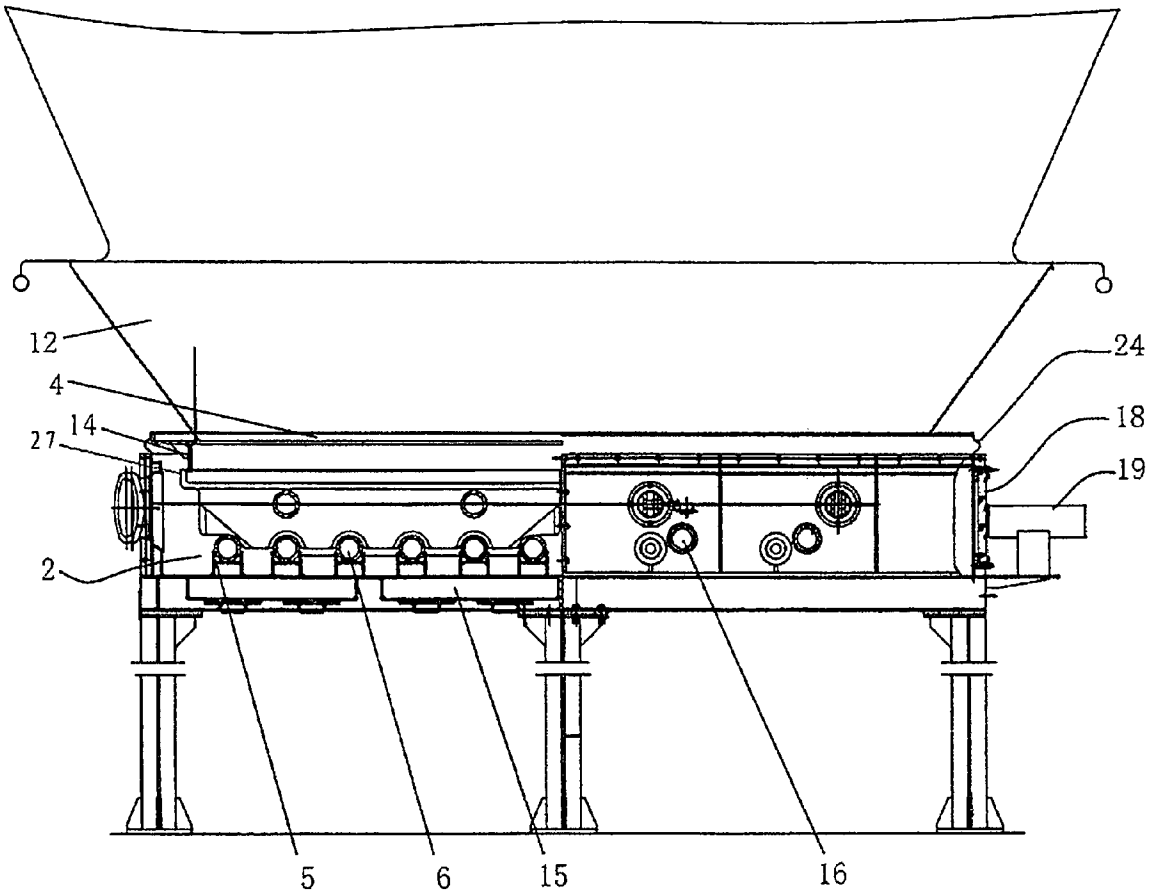
FIG. 2 is a side view of a bottom ash discharging device for a coal-fired boiler in accordance with one embodiment of the invention.
Figure 3:
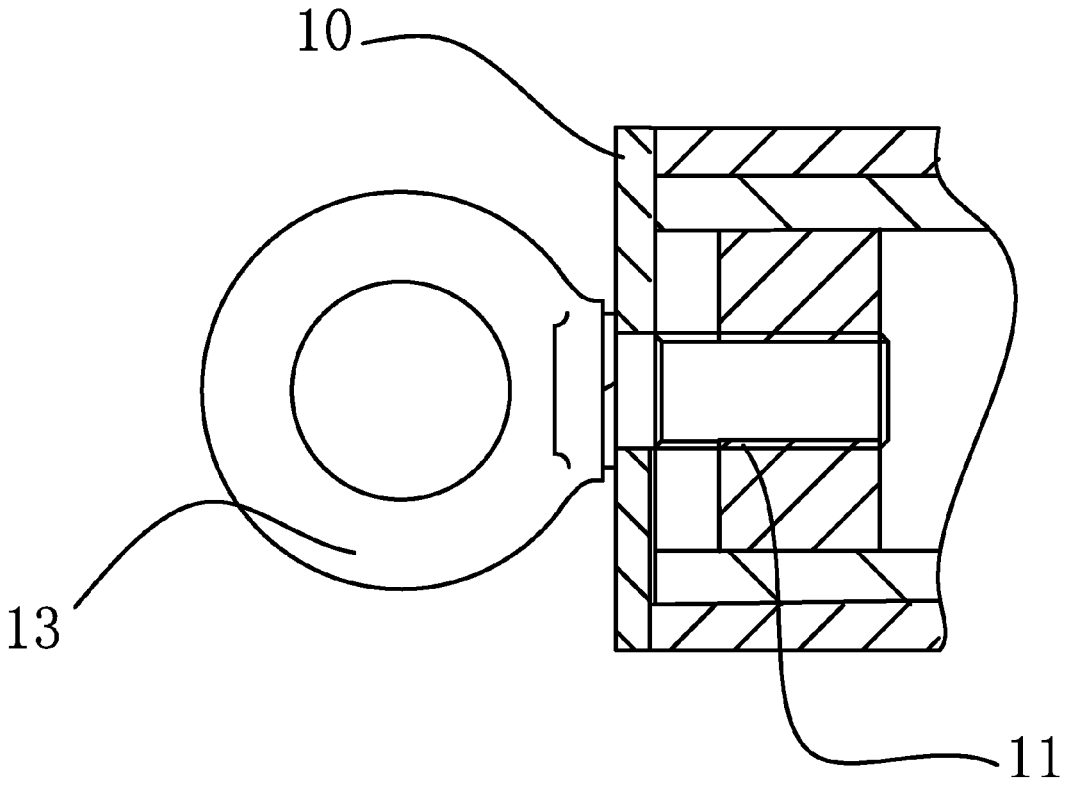
FIG. 3 is a schematic diagram of a stop means for a bottom ash discharging device for a coal-fired boiler in accordance with one embodiment of the invention.
Figure 4:
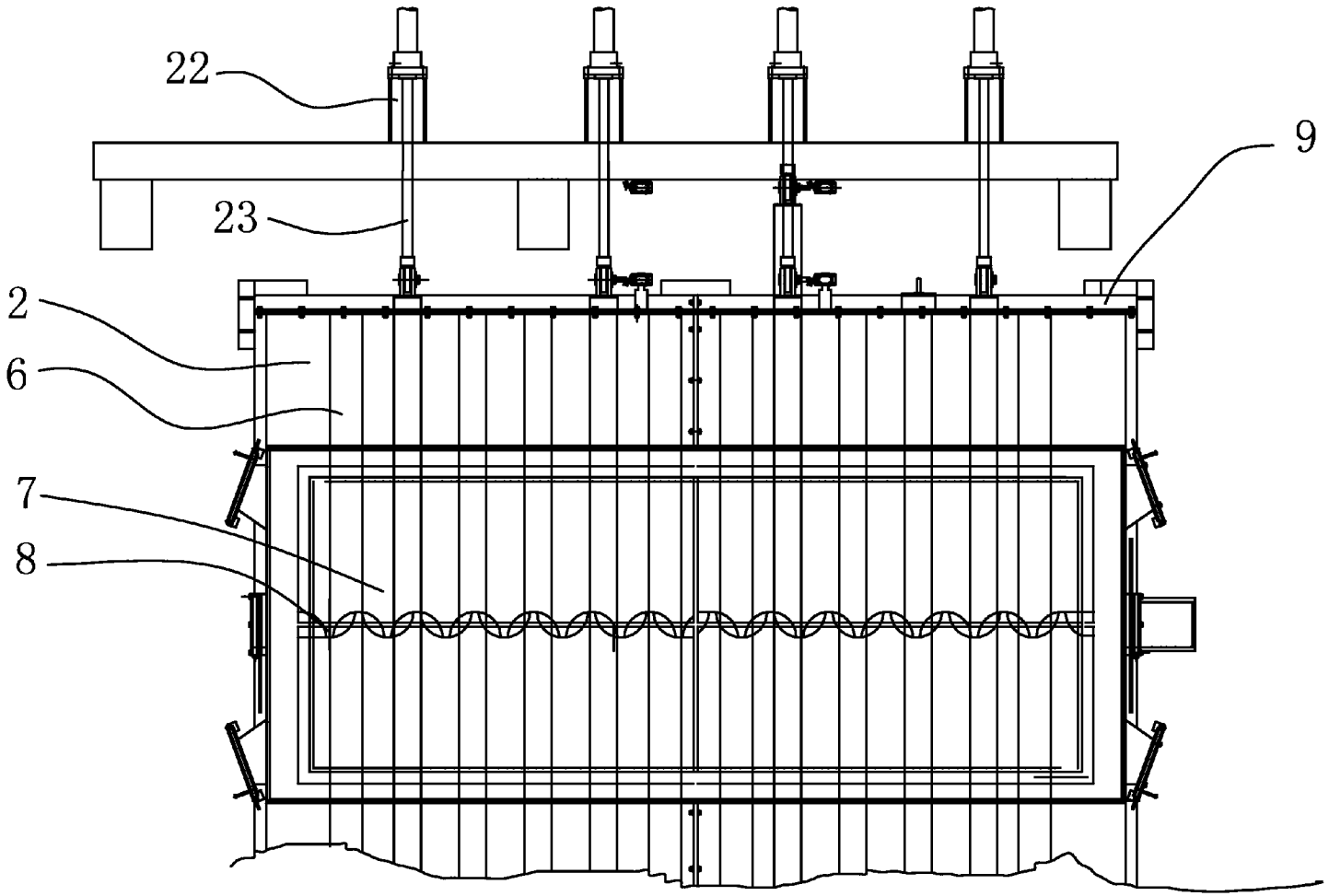
FIG. 4 is a top view of a bottom ash discharging device for a coal-fired boiler in accordance with one embodiment of the invention.
Figure 5:
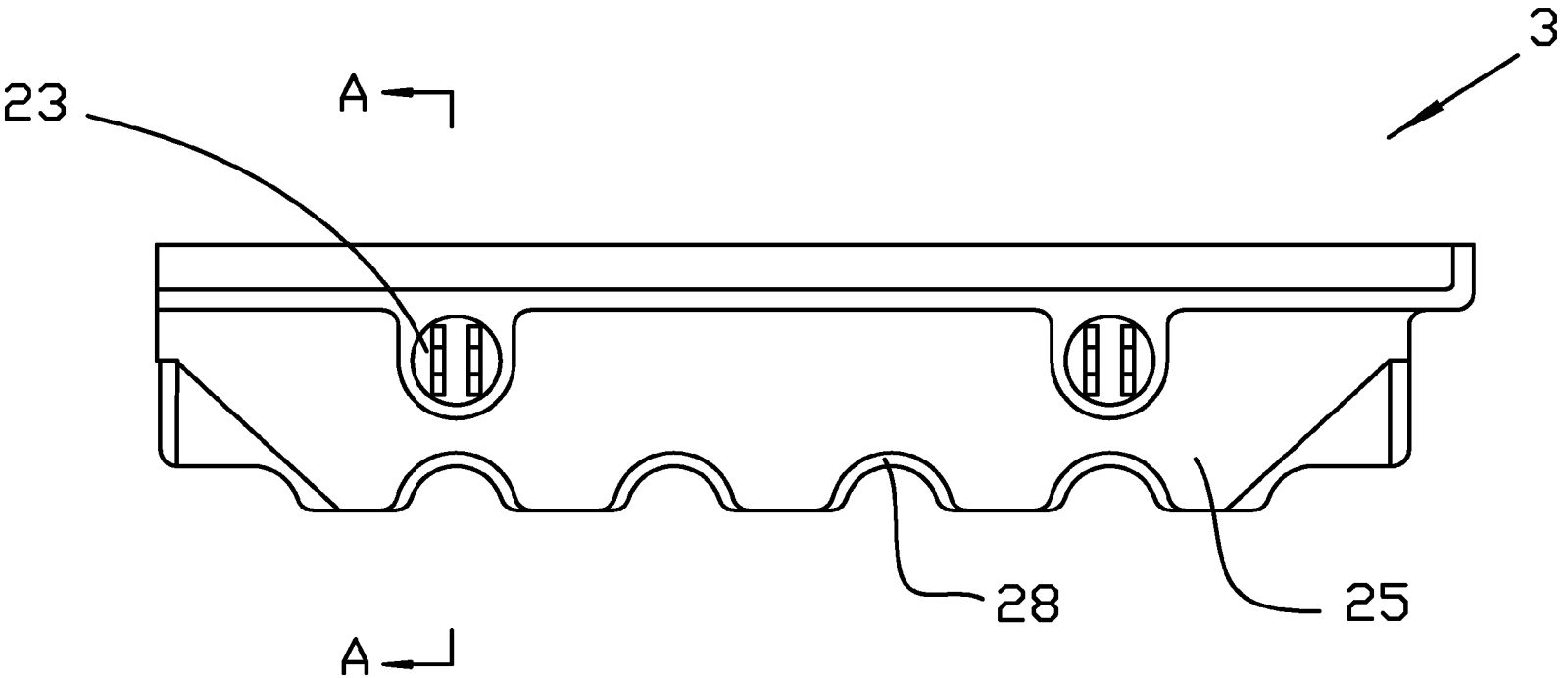
FIG. 5 is a side view of a clinker crusher of a bottom ash discharging device for a coal-fired boiler in accordance with one embodiment of the invention.
Figure 6:
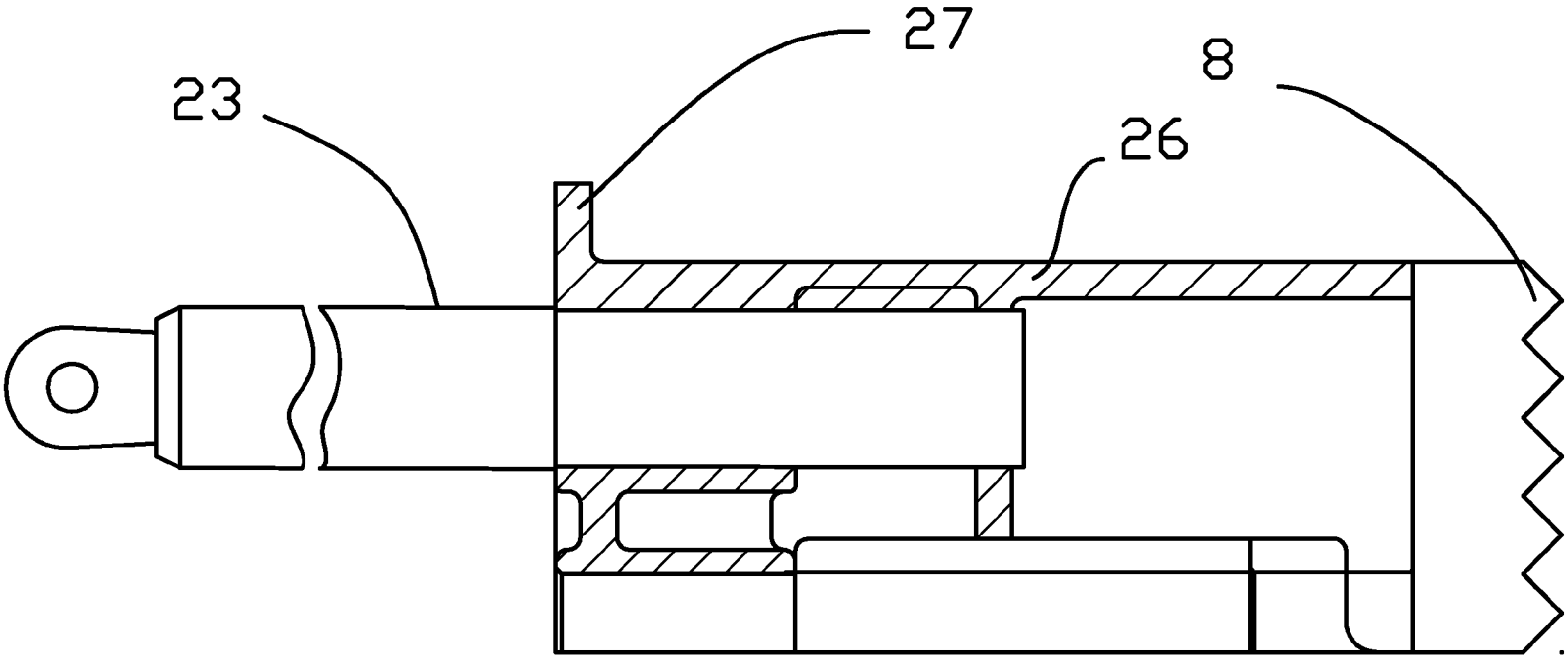
FIG. 6 is a sectional view of a clinker crusher of a bottom ash discharging device for a coal-fired boiler taken from the A-A line in accordance with one embodiment of the invention.
Figure 7:
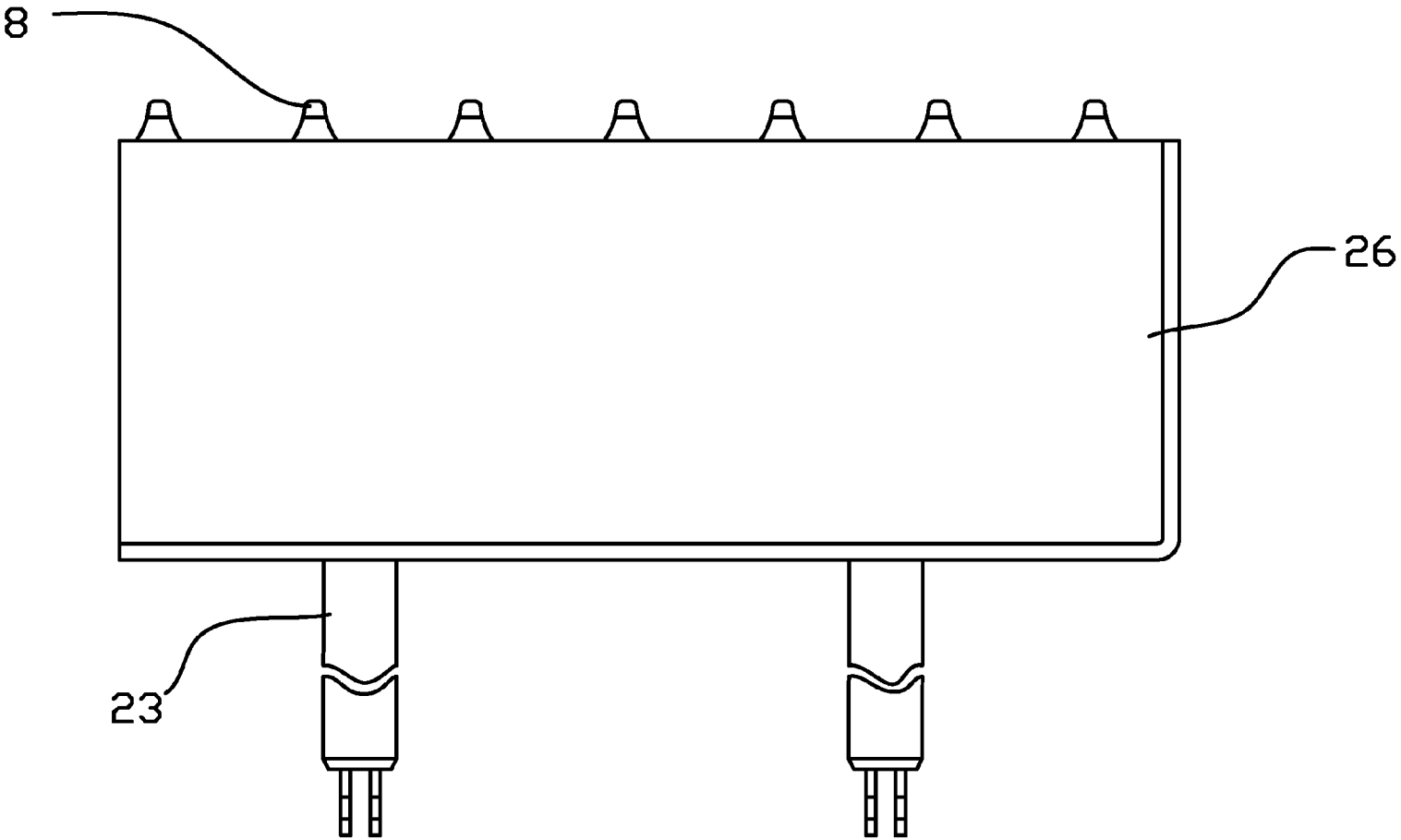
FIG. 7 is a top view of a single clinker crusher of a bottom ash discharging device for a coal-fired boiler in accordance with one embodiment of the invention.
Figure 8:
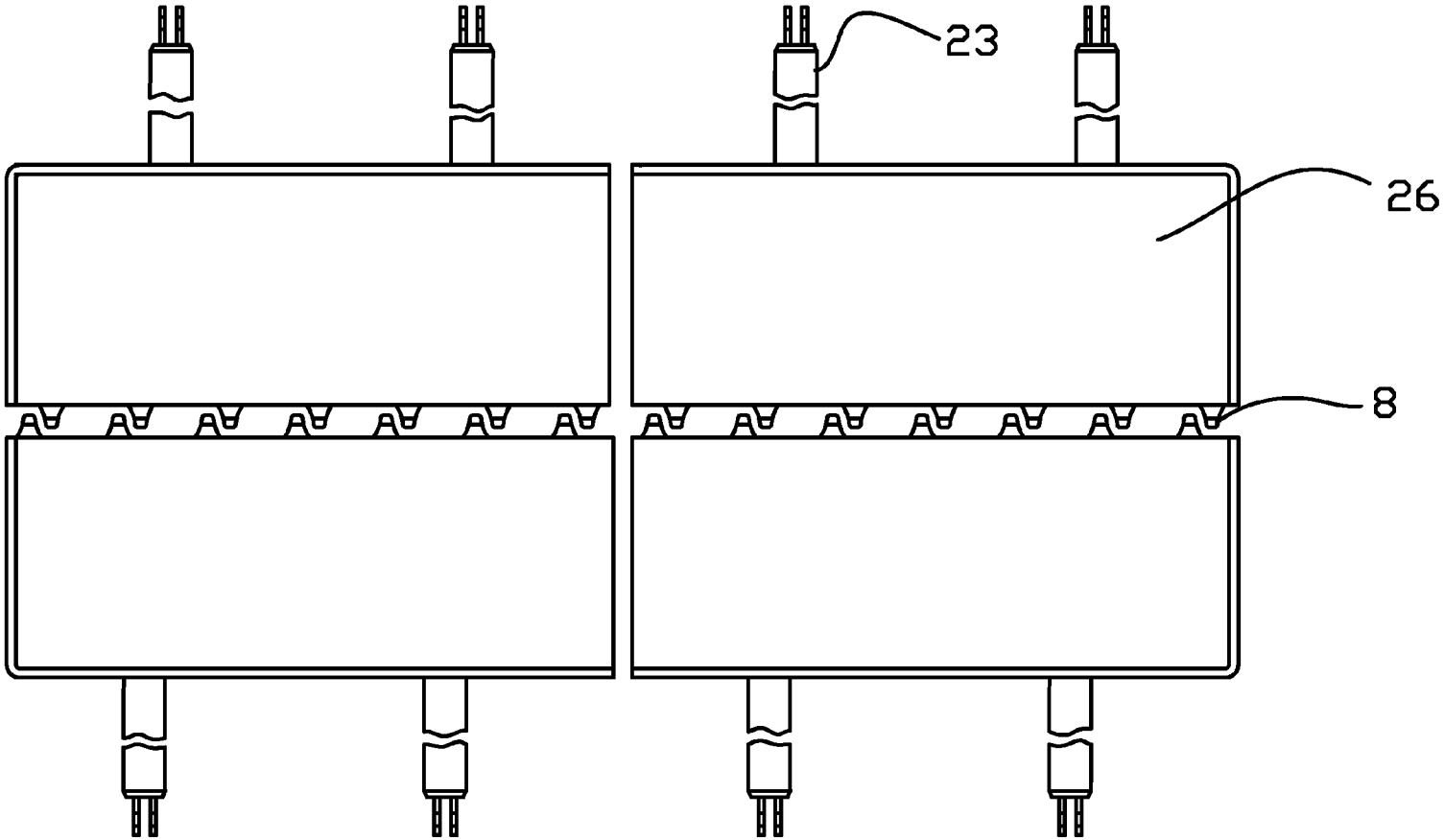
FIG. 8 is a combination view of two clinker crushers of a bottom ash discharging device for a coal-fired boiler in accordance with one embodiment of the invention.

As shown in FIGS. 1-8, a bottom ash discharging device for a coal-fired boiler is installed underneath a bottom ash hopper 12, and the bottom ash hopper 12 is connected to the lower end of a furnace, for receiving the bottom ash out of the furnace. The bottom ash discharging device comprises a clinker case 9, an impact bar 2, and a clinker crusher 3. The clinker case 9 is installed between a bottom ash hopper outlet 4 and a bottom ash conveyer 1. The impact bar 2 comprises a plurality of heat-resistant metal rods 6 propped up against the clinker case 9, and the clinker crusher 3 is installed above the impact bar for crushing the clinker. The impact bar 2 is adapted for preventing the large clinker from dropping onto the bottom ash conveyer 1, and the clinker crusher is movable above the impact bar 2, for crushing the large clinker into small ones, so that the smaller ones may drop down through the intervals of the impact bar, and then the bottom ash conveyer 1 may discharge the ash from the bottom ash hopper outlet 4 and the clinker crusher to another crushing and screen device.

A guiding device is installed between the bottom ash hopper outlet 4 and the clinker crusher 3, for limiting the clinker to drop into the clinker crushing area of the clinker crusher 3 which is inside the baffle plate. In the example, the guiding device is a guiding plate 14, which are welded around the bottom ash hopper outlet 4. The guiding plate ensures that the clinker may drop into the crushing area of the clinker crusher so as to avoid the clinker drops to the back area of the clinker crusher, in which the clinker cannot be crushed; the crushing area herein represents the area in which the clinker is able to be crushed by the slag crusher.

The clinker case 9 is installed on the bottom ash conveyer and supported by a clinker case supporting structure 20, which is for supporting the clinker crusher and the impact bar 2. An expansion joint 24 is installed on the top of the clinker case 9, which is able to absorb the downward thermal expansion of the bottom ash hopper. Side walls of the clinker case 9 are connected with each other via bolts and nuts; the bolts are dismountable and the side walls of the clinker case 9 can be opened for repairing in case that the clinker crusher 3 or the impact bar 2 is broken, which is quite convenient for repairing. A camera window 18 and an observation window 17 are formed in the appropriate position of the clinker case, for observing the state of the large clinker accumulating on the impact bar. The camera installed outside the camera window 18 records the accumulation of clinker and send the video signal to the displayer, so that the operator may get the information about the position of the large clinker through the displayer and manipulate the working of the clinker crushing body to crush the clinker accordingly. The operator also may directly observe the state of the impact bar through the observation window 17 and may open the observation window 17 to cleanup sundries on the impact bar 2.

The impact bar 2 comprises a plurality of heat-resistant metal rods 6. Two ends of the heat-resistant metal rod 6 are supported on the clinker case 9 via a supporting beam 5, and at least one end of the heat-resistant metal rod 6 is dismountable and fixed on the clinker case 9 through a stop means for restricting the axial movement of the heat-resistant metal rod 6. The stop means comprises a screw hole 11 that is welded inside the heat-resistant steel bar and installed at the end of the bar, an opening installed on the side wall of the clinker case 9 for pulling out the heat-resistant metal rod 6, a cover installed outside of the clinker case 9 for sealing the openings and fixing the heat-resistant metal rod 6, and holes on the cover 10 for allowing a ringbolt 13 to pass through. One end of the ringbolt 13 passes through the hole of the cover 10 and then match the screw hole 11. Of course, the shape of the supporting beam 5 may be variable according to the real conditions, for example, the supporting beam fixed on the clinker case 9 can be circular, as long as the supporting beam is able to support the heat-resistant steel bar. When large clinker drops onto the impact bar 2 and smashes one or some of the heat-resistant steel bar, in order to repair or replace the bar, the maintainer can hold and turn round the ringbolt 13 to screw it out of the screw hole 11, and then pull out the broken heat-resistant steel bar. Therefore, it is not necessary to shutdown the device, because only replacing one or some of the heat-resistant steel bar will not affect the boiler's discharging work. And it may increase the efficiency, lower the cost and save the labor, in comparison with the design that the impact bar 2 is fixed on the clinker case 9 or integrally formed thereon. The intervals of the heat-resistant metal rods of the impact bar 2 allow granulated ash and small bottom ash to directly drop onto the bottom ash conveyer 1, and meanwhile, large clinker is headed off and stays on the impact bar. On one hand, it may protect the bottom ash conveyer from being damaged by large clinker; on the other hand, it prolongs the cooling time of the large clinker, so as to reduce the temperature of the clinker to a level at which the clinker will not damage the conveyer.

The clinker crusher 3 is installed above the impact bar 2, which comprises clinker crushing components 25 and a driving device for driving the clinker crushing components to move in axial direction; a pushing rod 23 is installed between the clinker crushing components 25 and the driving device for transmitting the driving force between the driving device and the clinker cased components, and a plurality of clinker crushing bodies 7 are formed on the clinker crushing component. A protection plate 26 is installed above the clinker crushing components 25 for protecting the clinker crushing body; a plurality of baffle plates 27 extending upwardly are disposed around the clinker crushing components 25. The guiding plate 14 are closer than that of the baffle plate 27 to the clinker crushing body 7, and the bottoms of the guiding plate 14 are lower than the top edge of the baffle plates. At least one chute 28 is installed underneath at least two clinker crushing components 25 and on/above the heat-resistant steel bar of the impact bar 2, for allowing the clinker crushing components to slide on, wherein, the clinker crushing components 25 on the same chute moves relatively. Three rectangular pyramid shaped clinker crushing jaws are formed on the clinker crushing body 7 with vertical arrangement, and a pair of clinker crushing jaws of the clinker crushing body on the same chute 28 engages with each other to crush the clinker under driving force. In this example, three cone-shaped clinker crushing jaws 8 are formed on each clinker crushing body with vertical arrangement, the cone angle of which is 60°-90°. And these jaws can provide larger pressure intensity than the jaws with flat top under the same driving force, so as to tightly grip on the large clinker with irregular structure and then crush it. In this example, the driving device is a hydraulic cylinder 22, which is supported by a bottom ash hopper supporting structure 21 of the bottom ash hopper. Each clinker crushing component is driven by two hydraulic cylinders 22 in parallel connection with each other, and a pushing rod 23 is installed between each hydraulic cylinder 22 and each clinker crushing component 25, for transmitting the driving force. The hydraulic cylinder 22 is provided with a travel switch for controlling the length of travel of the clinker crushing body. Another advantage of having the clinker crushing body 7 is that the clinker crushing body 7 can be stopped working when the bottom ash conveyer shuts down, lump and clinker can be temporarily stored in the bottom ash hopper, so as to prevent too much lump and clinker from damaging the clinker conveyer. In addition, the guiding device which guides the clinker to drop into the area encompassed by the baffle plate 27 also may be with different structures which may facilitate the dropping of the clinker, for example, the guiding device can be composed of a plurality of guiding grooves, of which the cross section is U-shaped, and which are installed circularly along the baffle plate 27.

Preferably, an ash discharging device is installed in the area that is not covered by the protection plate 26, which is under the impact bar 2. In the example, the ash discharging device may be an ash silo 15 with an ash discharging door, the ash silo 15 is able to store partial fly ash, in addition, the ash discharging door of the ash silo can be opened to discharge the fly ash after a certain amount of fly ash accumulates in the ash silo 15. The ash silo 15 prevents the fly ash from accumulating in the space between the clinker case 9 and the clinker crushing body 7. The accumulating affects the normal running of the device. The clinker case 9 is provided with an observation hole 16, which is installed underneath the clinker crushing body 7. The operator can observe the state of the ash accumulating in the ash silo 15 from the observation hole 16, and can open the door to clear the ash after a certain amount of ash accumulates therein.

A second embodiment of the invention is the same as the first embodiment, except that the end of the heat-resistant steel bar is provided with an internal screw thread, which matches the ringbolt, and the clinker crushing body may be cone-shaped, and the ash discharging device may be a discharging door installed on the clinker case, and the operator can open the door to discharge partial fly ash after a certain amount of fly ash accumulates in the space between the clinker case and the impact bar.

A third embodiment of the invention is the same as the first embodiment, except that the heat-resistant metal rod may be a solid shaft, and two ends of the heat-resistant metal rod are supported by the clinker case via two supporting beams and fixed on the clinker case via stop means, i.e. each end of the heat-resistant metal rods passes through the hole of the cover 10, and a small hole whose orientation is perpendicular with the heat-resistant metal rods, formed on the segment of the heat-resistant metal rods, which exposes to outside of the clinker case. A pin passes through the small hole and is installed therein, which cooperates with the cover for restricting the axial movement of the heat-resistant metal rods.

A fourth embodiment of the invention is the same as the first embodiment, except that a stop means is installed at one end of the heat-resistant metal rods, one end of the heat-resistant metal rods passes through the hole of the cover, and a small hole whose orientation is perpendicular with the heat-resistant metal rods is formed on the segment of the heat-resistant metal rods, which exposes to outside of the clinker case; and two metal rings are installed on the clinker case, and the axis of each ring is perpendicular with the heat-resistant metal rods. A pin successively passes through one of the metal rings, the small hole of the heat-resistant metal rods, and another metal ring. The pin cooperates with the cover for restricting the axial movement of the heat-resistant metal rods, and the other end of the heat-resistant metal rods is sealed in the clinker case by the cover without the small hole.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A bottom ash discharging device for a coal-fired boiler, comprising:

a) a clinker case;

b) a grate;

c) a clinker crusher; and d) an ash guiding device;

wherein the grate is disposed inside the clinker case and comprises a plurality of metal rods;

the clinker crusher is installed above the grate for crushing clinkers;

the ash guiding device is installed between a bottom ash hopper outlet of the coal-fired boiler and the clinker crusher for limiting the clinkers to drop into a clinker crushing area, so as to prevent the clinkers from dropping into an area where the clinker crushing body cannot reach;

an upper end of the ash guiding device is connected to the bottom ash hopper outlet;

the guiding device is a vertical guiding plate positioned vertically below and around the bottom ash hopper outlet;

the clinker crusher comprises at least a pair of clinker crushing components with relative movement for crushing the clinkers and a driving device for driving the clinker crushing components;

a clinker crushing body is installed on a front end of each clinker crushing component;

at least one baffle plate positioned vertically below the bottom ash hopper outlet and on a rear end of each clinker crushing component, the baffle plate extending upwardly; and the guiding plate is closer than the baffle plate to the clinker crushing body.

2. The bottom ash discharging device of claim 1, wherein the clinker case is installed between the bottom ash hopper outlet and a bottom ash conveyor.

3. The bottom ash discharging device of claim 1, wherein a protection plate is disposed above the clinker crusher component for protection of the clinker crushing body; and a bottom ash discharging device is installed underneath the grate which is not covered by the protection plate.

4. The bottom ash discharging device of claim 3, wherein the bottom ash discharging device is an ash discharging door installed on the clinker case.

5. The bottom ash discharging device of claim 3, wherein the bottom ash discharging device is an ash silo with an ash discharging door, which is formed on the clinker case.

6. The bottom ash discharging device of claim 3, wherein the clinker case further comprises an observation window or a camera window for observing the state of the accumulation of large clinker dropped on the grate and an observation hole for observing the state of ash storage in the ash storage device.

7. The bottom ash discharging device of claim 1, wherein the driving device is a hydraulic cylinder and each clinker crushing body is driven by two hydraulic cylinders in parallel connection.

8. The bottom ash discharging device of claim 7, wherein a pushing rod is installed between the clinker crusher component and the hydraulic cylinder for the transmission of driving force between the hydraulic cylinder and the clinker crusher component.

9. The bottom ash discharging device of claim 1, wherein a plurality of cone-shaped clinker crushing jaws are formed horizontally on an extrusion end of the clinker crushing body.

10. The bottom ash discharging device of claim 9, wherein the shape of the clinker crushing jaws is in the form of a rectangular pyramid.

11. The bottom ash discharging device of claim 1, wherein the grate is removably attached to the clinker case.

12. The bottom ash discharging device of claim 11, wherein two ends of each metal rod are fixed on the clinker case through supporting beams; and at least one end of each metal rod is removably attached to the clinker case through a stop member for restricting axial movement of the metal rod.

13. The bottom ash discharging device of claim 1, wherein a bottom edge of the guiding plate is lower than a top edge of the baffle plate.

14. The bottom ash discharging device of claim 13, wherein the grate is removably attached to the clinker case.

15. The bottom ash discharging device of claim 14, wherein two ends of each metal rod are fixed on the clinker case through supporting beams;

at least one end of each metal rod is removably attached to the clinker case through a stop member for restricting axial movement of the metal rod.

16. The bottom ash discharging device of claim 13, wherein the at least one baffle plate comprises a plurality of baffle plates extending upwardly and disposed around the clinker crushing components.

* * * * *